US005390838A

United States Patent [19]

Jafarkhani

[11] Patent Number: 5,390,838

[45] Date of Patent: Feb. 21, 1995

[54] PERSONAL BEVERAGE CUP HOLDER

[76] Inventor: Naser Jafarkhani, 8984 Sage Dr., Alta Loma, Calif. 91701

[21] Appl. No.: 73,387

[22] Filed: Jun. 9, 1993

[51] Int. Cl.[6] ..... A45F 5/00

[52] U.S. Cl. ..... 224/148; 224/258; 224/270

[58] Field of Search ..... 224/148, 258, 270

[56] References Cited

U.S. PATENT DOCUMENTS 2,494,632 1/1950 Rodin ..... 224/148 X
4,915,278 4/1990 Smith ..... 224/270 X
4,993,611 2/1991 Longo ..... 224/148
5,232,137 8/1993 Devine ..... 224/148 X

*Primary Examiner*—Henry J. Recla
*Assistant Examiner*—David J. Walczak

[57] ABSTRACT

Apparatus for holding and carrying various types of common beverage cups and cans, comprises an elongated cylindrical support unit that has a support for holding a changeable C-shaped receiving member, a support for a retractable L-shaped receptacle member and a support for a biblike separator that separates the cup from the user's chest. The apparatus is suspended at two points on the cylindrical support unit by a strap around the user's neck.

1 Claim, 3 Drawing Sheets

PERSONAL BEVERAGE CUP HOLDER

BACKGROUND OF THE INVENTION

1. Field of the Invention

This invention relates in general to devices for holding and carrying beverage containers. In particular this invention relates to devices for holding and carrying various sizes of beverage containers adapted to be worn comfortably and adjustably around a person's neck, and is retractable to conserve space when not in use.

2. Prior Art

It is common for people to drink beverages while they are walking, driving a car, watching movie, and at sporting events. These beverages are commonly sold in cups or cans. Such cups come in various sizes, and are circular in cross section. The circular is wider at the top than at the bottom, and has an open top and a closed bottom. When a beverage is served in such circumstances, the user needs to be very careful and properly handles the beverage container to avoid dropping or spilling.

The best prior art known to Applicant includes U.S. Pat. Nos. 4,754,903; 5,139,222; 4,767,092; 5,060,835; and 4,946,094. Most of the prior arts are devices for holding beverage containers that cooperate with the interior of an automobile, like U.S. Pat. Nos. 4,767,092 and 5,139,222.

U.S. Pat. No. 5,060,835, discloses a belt apparatus adapted to be secured around a person's waist and supports a beverage container, as well as other belongings of the person.

U.S. Pat. No. 4,946,094, discloses a complainer system having a container housing that is conpartmented to allow insert of packaged and unpackaged foodstuffs, and adapted to be removably coupled to the body of a user.

U.S. Pat. No. 4,754,903, discloses a softdrink carrier that is adapted to be secured around a person's neck. In such prior art the strap is not adjustable, as is provided in the subject invention concept. Furthermore, the pouch is not adapted to receive various sized cup diameters, as is provided in the subject invention concept.

SUMMARY OF THE INVENTION

A beverage cup holder and carrier system is provided and adapted to be worn around a user's neck, and to support a soft drink cup such that it freely rests against the user's chest.

The principal object of the present invention is to provide such a beverage carrier system that includes an adjustable strap means so that the carrier not only can be properly utilized by different sized persons but, the beverage container can get as close as possible to user's mouth, so the user can drink the beverage through the straw without using his/her hands.

Another object of the present invention is to provide such a device that, when employed, allows for the convenience of having hands free movement.

Another object of the present invention is to provide a device for holding various sized beverage cups, which are circular in cross section and having an outwardly tapered side wall in a direction from a bottom to a top.

Another object of the present invention is to provide a device for holding various sized beverage cups and cans, which are circular in cross section and have a straight side wall.

Another object of the present invention is to provide a system for holding and carrying beverage cups of various sizes around a person's neck.

Another object of the present invention is to provide a system for holding and carrying drinking cups that have a handle.

Another object of the present invention is to provide such a beverage carrier system that includes a separator or a biblike system, for separating the cup from user's chest, and to prevent spillage of beverage on the clothing of user.

A further object of the present invention is to provide a system for holding and carrying various types of beverage containers that can be retracted when not in use to conserve space.

It is another object of the present invention to provide an inexpensive, easily manufacturable beverage cup holder that may be disposed after use.

DETAILED DESCRIPTION

BEST MODE FOR CARRYING OUT THE INVENTION

Figure 10:
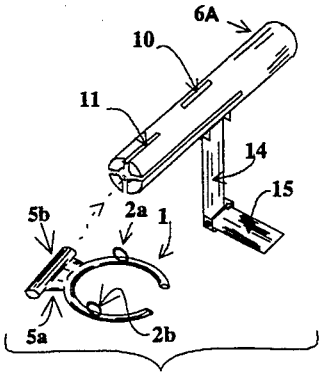
FIG. 10 shows how receiving member can be slid through members 8 and 13.
Figure 11:
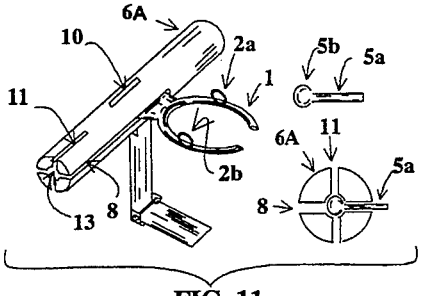
FIG. 11 shows that receiving members is slid in, and on the right their cross sections can be seen.

The preferred embodiment of the present invention is illustrated in FIGS. 10 and 11, which includes a receiving member. Receiving member includes element 5*a*, element 5*b*, a ring member 1, and two small circular opening therethrough elements. They are attached to each other as illustrated in FIG. 10. Element 5*b* is a small elongated cylindrical element parallel to the ring member's diameter, and it's midpoint lines up on the symmetrical line of ring member.

Figure 9:
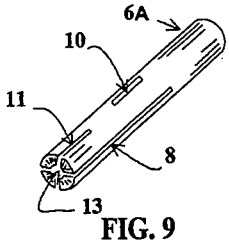
FIG. 9 is an enlarged, side view of elongated cylindrical support element 6A.

The apparatus also includes an elongated cylindrical support element 6A which will be called cylinder for short. Cylinder is illustrated in FIG. 9, which is an elongated cylindrical rod like device, preferably made from plastic, and includes a slot member 10, an elongated cylindrical hole 13, and two perpendicular slit members 8 and 11. Slot member 10 is made long and wide enough to accept the support flap member 9, central axis of the elongated cylindrical hole member 13 is along the cylinder central longitudinal axis, the perpendicular slit elements are opening therethrough elements and pass cylinder central longitudinal axis. Slit member 11 is parallel to slot member 10 and is made to accept strap member 3. Slit member 8 along with elongated cylindrical hole member 13 are made to accept 5*a* and 5*b* elements. The width of slit member 8 is smaller than the diameter of the elongated cylindrical hole member 13, and slightly bigger than the element 5*a* width.

The whole thing is made somehow that receiving member (elements 5*a* and 5*b*) can be slid through the elongated cylindrical hole 13 and slit 8, slid all the way and stop where the midpoint of small cylindrical element 5*b* lines up on the midpoint of cylindrical member 6A.

Figure 4:
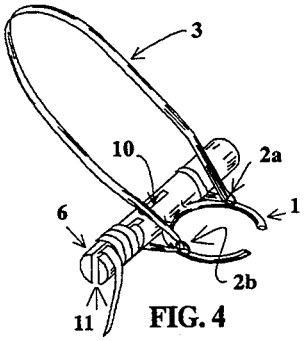
FIG. 4 shows how Strap member 3 can be connected to member 6, when members 2*a* and 2*b* are present.
Figure 5:
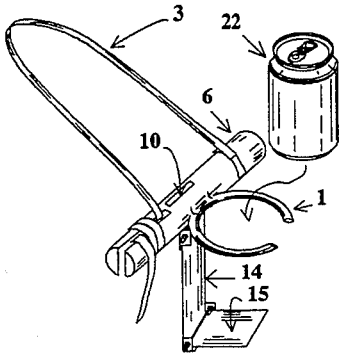
FIG. 5 shows how Strap member 3 can be connected to member 6, when members 2*a* and 2*b* are not present.
Figure 6:
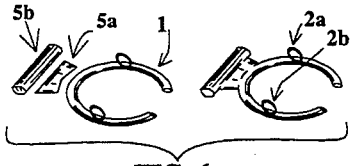
FIG. 6 displays one form of receiving member.
Figure 7:
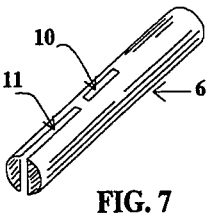
FIG. 7 is an enlarged, side view of elongated cylindrical support element 6.

The apparatus further includes a strap member 3, constructed of any appropriate material such as plastic, nylon fabric, leather, etc., and has two ends. As illustrated in FIG. 4 and 5, there are two ways to connect this strap member around user's neck: 1) having one end fixedly secured to one end of elongated cylindrical support element 6A and an opposing strap end after passing through small circular member 2*a* adapted to pass around the neck portion of the user, then passes through small circular member 2*b*, and then passes through slit member 11. That part of the strap member that passes through slit 11 may be wrapped around elongated cylindrical support element 6A (over slit 11), as shown in FIG. 4 and 5. slit 11 shall be made tight enough to hold the strap member in place. 2) Subsequent to the use, strap member 3 may not pass through small circular elements 2*a* and 2*b*, but instead directly passes around user's neck and then passes through slit 11.

Figure 8:
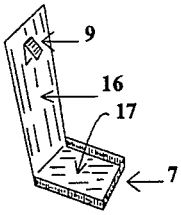
FIG. 8 is an enlarged, side view of separator member 7.

Apparatus also includes a separator member 7, illustrated in FIG. 8, which separates the cup from the user's chest and provides for a biblike device to prevent spillage. The separator member is constructed of any appropriate material such as plastic, paper, etc., preferably a material that can absorb spillage. Separator member 7 includes a first leg 16 having a support flap member attached to one end of it, and a second leg 15 attached to the other end of first leg 16 and extending below L-shaped receptacle element. Separator member 7 is suspended between the cylinder 6A and user's chest when support flap member 9 is inserted into the slot element 10. Second leg 15 may have an angle between 90 to 120 degree with respect to first leg 16, and may have sides that will come up so, if the beverage is spilled, it will be collected in there.

In order to hold cylindrical beverage cups and cans, which are generally circular in cross section and having straight side wall, a L-shaped receptacle element can be added to the preferred embodiment. As shown in FIGS. 10 and 11, the L-shaped element is attached under member 6A.

Figure 13:
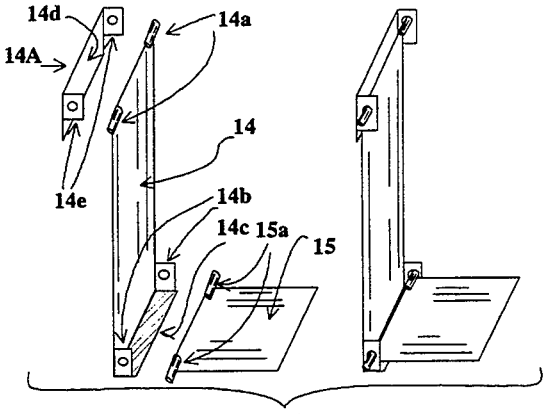
FIG. 13 is an enlarged side view of L-shaped member.

The L-shaped receptacle member as illustrated in FIG. 13 includes, a vertical leg 14, part 14A ,and a horizontal leg 15, where horizontal leg 15 is hingedly connected to vertical leg 14 and can only be moved upward when it is in horizontal position, vertical leg 14 is hingedly connected to cylinder 6A and can only be moved toward front. Top edges of part 14A are attached under member 6A. Rectangular element 14*c* is perpendicularly connected to one end of first leg 14, two small rectangular elements 14*b* are perpendicularly connected at the end corners of 14 and 14*c*. Two small cylindrical parts 14*a* are connected to the other end of first leg 14. Part 14A includes rectangular part 14*d*, to which two small rectangular elements 14*e* are perpendicularly attached to it's ends, 14*e* elements are flexible enough to accept 14*a* parts, so part 14 can be removed if there is no need for it. Two small cylindrical elements 15*a* are connected to rectangular part 15 as illustrated in FIG. 13. The small cylindrical elements 15*a* and 14*a* serve as hinge, they go through the holes of parts 14*b* and 14*e*. First leg 14 can be moved toward front but, part 14*d* will stop it from moving toward back. Second leg 15 can be moved upward but, can not be moved downward because of part 14C, and it's because of this feature that when a cylindrical beverage cup is inserted in the ring member, element 15 will hold the bottom and beverage cup will not fall through. In order to use the apparatus, user holds the elongated cylindrical support element in one hand and with the other hand inserts the right size of the receiving member into the elongated cylindrical support element. Now grabs the strap member which is already passed through small circular opening 2*a*, and pass it around his/her neck, then through small circular opening 2*b*, then through slit member 11. Now he/she can adjusts the position of the apparatus on his/her chest by moving the apparatus up or down and pulling the strap member. After positioning the apparatus s/he may insert the cup into the ring member. It is desirable for the ring member to support the cup anywhere above the midpoint in height of the cup, and adjacent the top for properly holding the cup.

Figure 1:
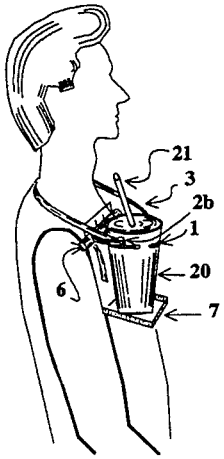
FIG. 1 is a side elevation of the Personal Cup Holder as worn around the neck of the user in accordance with the present invention.
Figure 2:
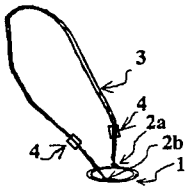
FIG. 2 is the simple form of the present invention.

In FIG. 2, the simplest form of the present invention has been illustrated. The simplest form includes a receiving member, which includes (1) a ring member 1, that has a circular opening therethrough, the circular opening has a circumferential edge bounding the opening, and (2) two small circular opening therethrough elements 2*a* and 2*b*, preferably attached on the opposing ends of the ring member diameter, away from path of receiving cup.

Figure 3:
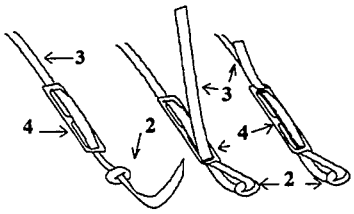
FIG. 3 is one way of connecting and adjusting the strap member 3 to the ring member 1.

The simplest form also includes a strap member 3, which has two ends, one end passes through 2*a* and then passes through length adjustment means 4, and the other end after passing around user's neck it passes through 2*b* and then passes through length adjustment means 4 as shown in FIG. 3.

Ring member 1 constructed of any appropriate material such as metal, plastic, wood, fabric, cardboard, jewelry chain, VELCRO, etc., preferably rigid material, strong enough to hold the beverage container.

Strap member can be made of VELCRO, which is a nylon material made with both a surface of tiny hooks and a complimentary surface of an adhesive pile, used, as in garments, in matching strips that can be pressed together or pulled apart for easy fastening and unfastening. If VELCRO material is used for ring member, then the ring member can be adjusted to the size of the cup.

Figure 14:
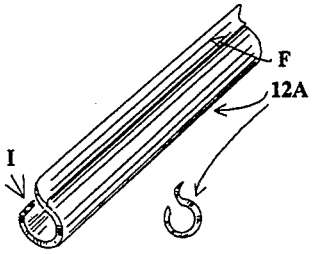
FIG. 14 is an enlarged side view of one form of holding member 12, and its cross section.
Figure 15:
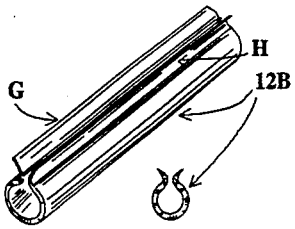
FIG. 15 is an enlarged side view of another form of holding member 12, and its cross section.
Figure 16:
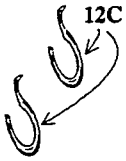
FIG. 16 is an enlarged side view of another form of holding member 12, and its cross section.
Figure 17:
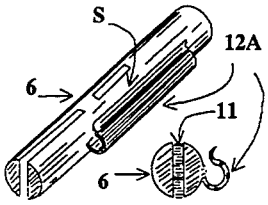
FIG. 17 shows how holding member 12A is attached to member 6, and its cross section.
Figure 18:
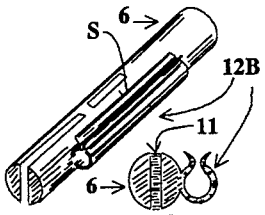
FIG. 18 shows how holding member 128 is attached to member 6, and its cross section.
Figure 19:
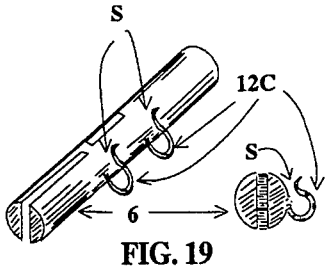
FIG. 19 shows how holding member 12C is attached to member 6, and its cross section.
Figure 20:
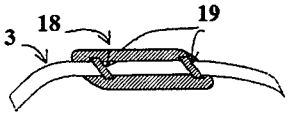
FIG. 20 shows side view of neck pad member 18 and how strap member is passing through it.
Figure 21:
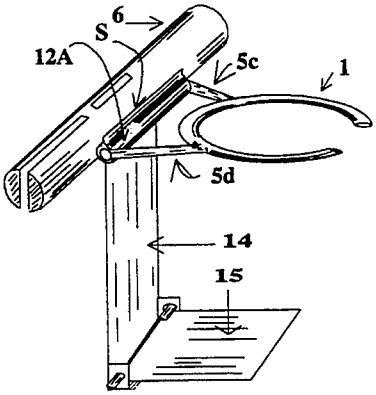
FIG. 21 is a side view of another form of the cup holder.
Figure 22:
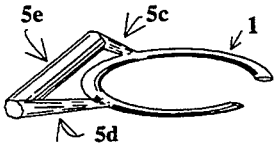
FIG. 22 is a side view of receiving member for cup holder in FIG. 21.

In FIG. 21, another form of the present invention is illustrated. This form includes a receiving member that is illustrated in FIG. 22, an elongated cylindrical support member 6, a L-shaped member and a holder member 12A. The receiving member as illustrated in FIG. 22, includes a ring member 1, and a small elongated cylindrical member 5*e*. Element 5*c* and element 5*d* connect the small elongated cylindrical member 5*e* to the ring member 1 somehow that leave a space between them. Holder member 12A as shown in FIG. 14 is a hollow cylindrical object, and included an elongated slit opening along it's length, along one of the edges of this elongated slit is raised and curved outward (shown as element F), the other edge which is called element I, is attached to the elongated cylindrical support member 6 with the elongated slit opening facing up. In order to use the apparatus, user holds the receiving member in his/her hand and puts the small elongated cylindrical member 5*e* over gap S, and push it till it snaps into the elongated slit opening and fits into the hollow cylinder and element F passes through the space between the small elongated cylindrical member 5*e* and the ring member 1. Gap S is the space between the element F and the elongated cylindrical support member 6. In case of need, receiving member can be pulled out, and use another receiving member with a different ring member size. In FIGS. 14, 15 and 16, three different forms of holder member 12, which are 12A, 12B ,12C , and their cross sections are illustrated. Holder member 12B is the same as 12A but, both edges of the slit opening (shown as elements G and H) are raised, and curved outward. Holder member 12C includes two C-shaped members, where one edge of C-shaped openings are raised and curved, and the other edges are attached to said elongated cylindrical support element 6, away from each other with said C-shaped openings facing up.

Figure 12:
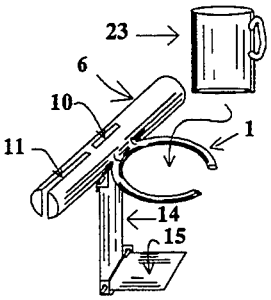
FIG. 12 is one form of the present invention, which shows side view of ring member, and L-shaped member, and how they are attached to member 6.

In FIG. 12, another form of the present invention is illustrated. In this form receiving member 1 is permanently attached to member 6 and is not changeable, this means both member 6 and receiving member need to be changed for various sized cups.

The foregoing descriptions of the specific forms and embodiments of the invention have been presented for the purpose of illustrations and descriptions. They are not intended to be exhaustive or to limit the invention to the precise forms disclosed. Many modifications and variations are possible in light of the above teaching. It is intended that the scope of the invention be limited not by this detailed description, but rather by the claims appended hereto.

I claim:

1. A retractable apparatus, for holding and carrying beverage cups of various sizes, adjustably to be worn around a person's neck, comprising:

an elongated cylindrical support element having a longitudinal axis, said elongated cylindrical support element includes a slot through a mid-section thereof and a slit through an end thereof;

a receiving member, said receiving member comprising:

a ring member attached to said support element at an intermediate portion thereof and extending laterally therefrom in a plane parallel to said axis, said ring member having a circular opening therethrough, said circular opening having a circumferential edge bounding said opening; and two small circular elements each having an opening therethrough and attached to said ring member diametrically opposed with respect to each other;

an L-shaped receptacle member having a first leg with one end secured to said support element and extending therefrom perpendicularly to said ring member and a second end connected to a second leg extending therefrom and parallel to said ring member for receiving cylindrical cans and cups;

a strap member having a first end connected to said support element and an opposite end passed through said small circular elements and secured in said slit for releasably and adjustably coupling said cylindrical support element around a persons neck;

a separator member having a flap member inserted into said slot and extending between said receptacle member and a user for preventing spillage from the cup onto a user's chest; and a neck pad on said strap for separating said strap member from a user's neck.

* * * * *